US012127647B2

(12) United States Patent
Lee

(10) Patent No.: US 12,127,647 B2
(45) Date of Patent: Oct. 29, 2024

(54) CANE WITH SEAT

(71) Applicant: Ming-Hsien Lee, Taichuang (TW)

(72) Inventor: Ming-Hsien Lee, Taichuang (TW)

( * ) Notice: Subject to any disclaimer, the term of this patent is extended or adjusted under 35 U.S.C. 154(b) by 171 days.

(21) Appl. No.: 17/943,463

(22) Filed: Sep. 13, 2022

(65) Prior Publication Data

US 2024/0065394 A1 Feb. 29, 2024

(30) Foreign Application Priority Data

Aug. 23, 2022 (CN) ..... 202211013536.8

(51) Int. Cl.
*A45B 5/00* (2006.01)
*A45B 9/00* (2006.01)
*A47C 9/10* (2006.01)

(52) U.S. Cl.
CPC ..... *A45B 5/00* (2013.01); *A47C 9/10* (2013.01); *A45B 2009/007* (2013.01)

(58) Field of Classification Search
CPC ..... A45B 5/00
See application file for complete search history.

(56) References Cited

U.S. PATENT DOCUMENTS 2,002,118 A * 5/1935 Johnson ..... A45B 5/00 297/118
2,649,140 A * 8/1953 Housel ..... A45B 5/00 248/431
3,266,839 A * 8/1966 Combs ..... A45B 5/00 248/155
D338,345 S * 8/1993 Camp ..... D6/353
5,871,025 A * 2/1999 Richter ..... A45B 3/00 135/65
6,467,843 B1 * 10/2002 Rossborough ..... A47C 9/10 108/150
6,899,388 B1 * 5/2005 Enrique ..... A47C 9/105 297/16.2
8,876,203 B1 * 11/2014 Haertl ..... A47C 4/04 297/29
9,066,584 B2 * 6/2015 Li ..... A47C 7/66
D964,013 S * 9/2022 Lu ..... D3/7
2006/0254633 A1 * 11/2006 Willis ..... A45B 9/00 135/65
2010/0200032 A1 * 8/2010 Lee ..... A45B 9/00 135/74
2024/0041217 A1 * 2/2024 Pao ..... A45B 5/00

FOREIGN PATENT DOCUMENTS

GB 2235371 A * 3/1991 ..... A45B 5/00

* cited by examiner

*Primary Examiner* — David R Dunn
*Assistant Examiner* — Danielle Jackson
(74) *Attorney, Agent, or Firm* — Birchwood IP

(57) ABSTRACT

The present application discloses a cane with seat, comprising: a cane pole, having a pole body, a pole foot and a sliding sleeve, a peripheral surface of the pole body is provided with a protruding limiting block, a top end of the pole foot is combined with a bottom end of the pole body, the sliding sleeve is slidably sleeved on the outer peripheral surface of the rod body; two chair poles, each with a pivot rod and a chair foot rod, a top of the chair foot rod is detachably inserted into a bottom end of the pivot rod, the pivot rods of the two chair poles are pivotally connected to both sides of the pole body of the cane; two chair pole elastic ropes, respectively arranged inside the corresponding chair poles; a chair cushion, a back surface of which is provided with two chair foot clips.

10 Claims, 9 Drawing Sheets

CANE WITH SEAT

CROSS-REFERENCE TO RELATED APPLICATIONS

This application claims the benefit and priority of Chinese patent application No. 202211013536.8, filed on Aug. 23, 2022, disclosure of which is hereby incorporated by reference in its entirety.

TECHNICAL FIELD

The present application relates to the technology in the field of mobility aids, in particular to a cane with seat.

BACKGROUND

Ordinary people, the elderly or those with a little inconvenience may carry crutches, trekking sticks, walking sticks or umbrellas as support equipment when walking to achieve the effect of saving effort.

However, implements such as crutches, trekking poles, walking sticks or umbrellas can only provide support when walking. If the user feels tired, sore feet, or physically uncomfortable halfway through the walk and wants to sit down and rest, then crutches, trekking poles, walking sticks or umbrellas are useless. The user can only borrow a seat from a nearby business, or find out whether there is an object to sit on the roadside, but it is usually not easy to find an object to sit on, so that the user cannot get a rest immediately.

Although there are existing structures combining chairs and walking sticks on the market, they are not ideal in terms of use or storage, and there are many areas for improvement.

SUMMARY

In view of this, the main purpose of the present application is to provide a cane with seat, which can effectively solve the problem that the existing cane with seat is not perfect in use and storage.

To achieve the above purpose, the present application adopts the following technical solutions:

a cane pole, having a pole body, a pole foot and a sliding sleeve, a peripheral surface of the pole body is provided with a protruding limiting block, a top end of the pole foot is combined with a bottom end of the pole body, and the sliding sleeve is slidably sleeved on the outer peripheral surface of the rod body;

two chair poles, each with a pivot rod and a chair foot rod, a top of the chair foot rod is detachably inserted into a bottom end of the pivot rod, the pivot rods of the two chair poles are pivotally connected to both sides of the pole body of the cane;

two chair pole elastic ropes, respectively arranged inside the corresponding chair poles, one end of each chair pole elastic rope is connected to the pivot rod, and the other end is connected to the chair foot rod, so as to provide an elastic force to make the chair foot rod move to the pivot rod;

a chair cushion, a back surface of which is provided with two chair foot clips, the back surface of the chair cushion is pivotally connected with the sliding sleeve of the cane and the pivoting rods of the two chair poles.

As a preferred embodiment, it further comprising a cane pole elastic rope; the top end of the pole foot and the bottom end of the pole body are detachably inserted together, the cane pole elastic rope is arranged inside the cane pole, and one end of the cane pole elastic rope is connected inside the pole body, and the other end is connected inside the pole foot, so as to provide an elastic force to make the pole foot move to the pole body; the back of the chair cushion further comprises a pole foot clip.

As a preferred embodiment, the pole foot comprises a pole foot rod, a pole foot fixing member and a pole foot elastic base, and a top end of the pole foot rod is inserted into the bottom end of the pole body, the pole foot fixing member is fixedly connected in the pole foot rod, the pole foot fixing member is connected with the cane pole elastic rope, and the pole foot elastic base is connected with a bottom end of the pole foot rod.

As a preferred embodiment, the bottom end of the pole body comprises a pole body insertion part with a reduced outer diameter, and the top end of the pole foot is inserted into the pole body insertion part; the bottom end of the pivot rod of each chair pole comprises a chair foot insertion part with a reduced outer diameter, and a top end of the chair foot rod is inserted into the chair foot insertion part.

As a preferred embodiment, the cane with seat is configured to be able to convert into a storage form, when the cane is in the storage form, the chair cushion is in an up-lifted position, and the pole foot is separated from the pole body, and the pole foot is clamped in the pole foot clip, the chair foot rod is separated from the pivot rod, and the chair foot rod is clamped into the chair foot clip.

As a preferred embodiment, the cane pole comprises an adjusting member and a safety restraint ring; the pole body comprises a pole head and a pole shaft, the pole head is T-shaped, and a top is configured to be hold by a human hand, a through-hole is formed on one side of the pole head, an outer thread is provided on an outer peripheral surface of a top end of the pole shaft, a limiting block is arranged on the pole shaft, and the pole shaft comprises a plurality of positioning holes, which are extend along an axial direction between the outer thread and the limiting block, the top end of the pole shaft is configured for insertion of a bottom end of the pole head, the pivot rods of the two chair pole are pivotally connected to both sides of the pole shaft; the adjusting member comprises an elastic body and a button, the elastic body is fixedly connected to the inside of the pole head, the button is connected with the elastic body, and goes outward through the through-hole of the pole head and any one of the positioning holes of the pole shaft under an action of an elastic force of the elastic body, so as to locate an axial relative position between the pole head and the pole shaft, when the button is located in different positioning holes, the depth of the pole head inserted into the pole shaft can be adjusted to change the overall height of the cane pole; an inner peripheral surface of the safety restraint ring is provided with an inner thread, and the inner thread is screwed with the outer thread of the pole shaft, when the safety restraint ring is tightened by the external force, the pole shaft is pressed against the pole head, so that the pole head and the pole shaft cannot be displaced relative to each other, when the safety restraint ring is loosened by external force, the button can be pressed to cause the relative displacement of the pole head and the pole shaft; the sliding sleeve is sleeved on the pole shaft, and an escape groove extended axially is formed concavely on an inner peripheral surface of the sliding sleeve, and the escape groove faces a plurality of positioning holes.

As a preferred embodiment, the chair foot rod of the chair pole comprises a chair foot rod body, a chair foot fixing member and a chair foot elastic base, and the chair foot fixing member is fixedly connected to inside of the chair foot rod body, the chair foot fixing member is connected with the chair pole elastic rope, and the chair foot elastic base is connected with a bottom end of the chair foot rod body.

As a preferred embodiment, the cane with seat is configured to be able to arbitrarily convert between a cane form and a chair form.

As a preferred embodiment, when in the cane form, the chair cushion is in an down-folded position, the chair foot rod of the chair pole is separated from the pivot rod, and the chair foot rod is clamping into the chair foot clip of the chair cushion.

As a preferred embodiment, when in the chair form, the pivot rod is inserted into the chair foot rod, the chair cushion is in the up-lifted position, and the two chair poles are driven by the chair cushion and form an included angle with the cane pole, the sliding sleeve is driven by the chair cushion, and slides along the pole body to abut against the limiting block.

As a preferred embodiment, the limiting block is circumferentially arranged on the outer peripheral surface of the pole body.

Compared with the prior art, the present application has obvious advantages and beneficial effects. Specifically, it can be known from the above technical solutions:

This product can be easily converted into cane form, chair form and storage form for convenience in use. In this product, the pole head of the pole body of the cane pole can be positioned by the adjusting member in different positioning holes, and then pulled up or pushed down, so as to achieve the effect of adjusting the overall height of the cane pole. This enables users with different heights and hand lengths to use this product in accordance with their own height and body shape, so as to achieve the comfort of use. That is, this product can be applied to most users and is highly competitive in the market.

In order to illustrate the structural features and effects of the present application more clearly, the present application will be described in detail below with reference to the accompanying drawings and specific embodiments.

REFERENCE SIGNS

Figure 1:
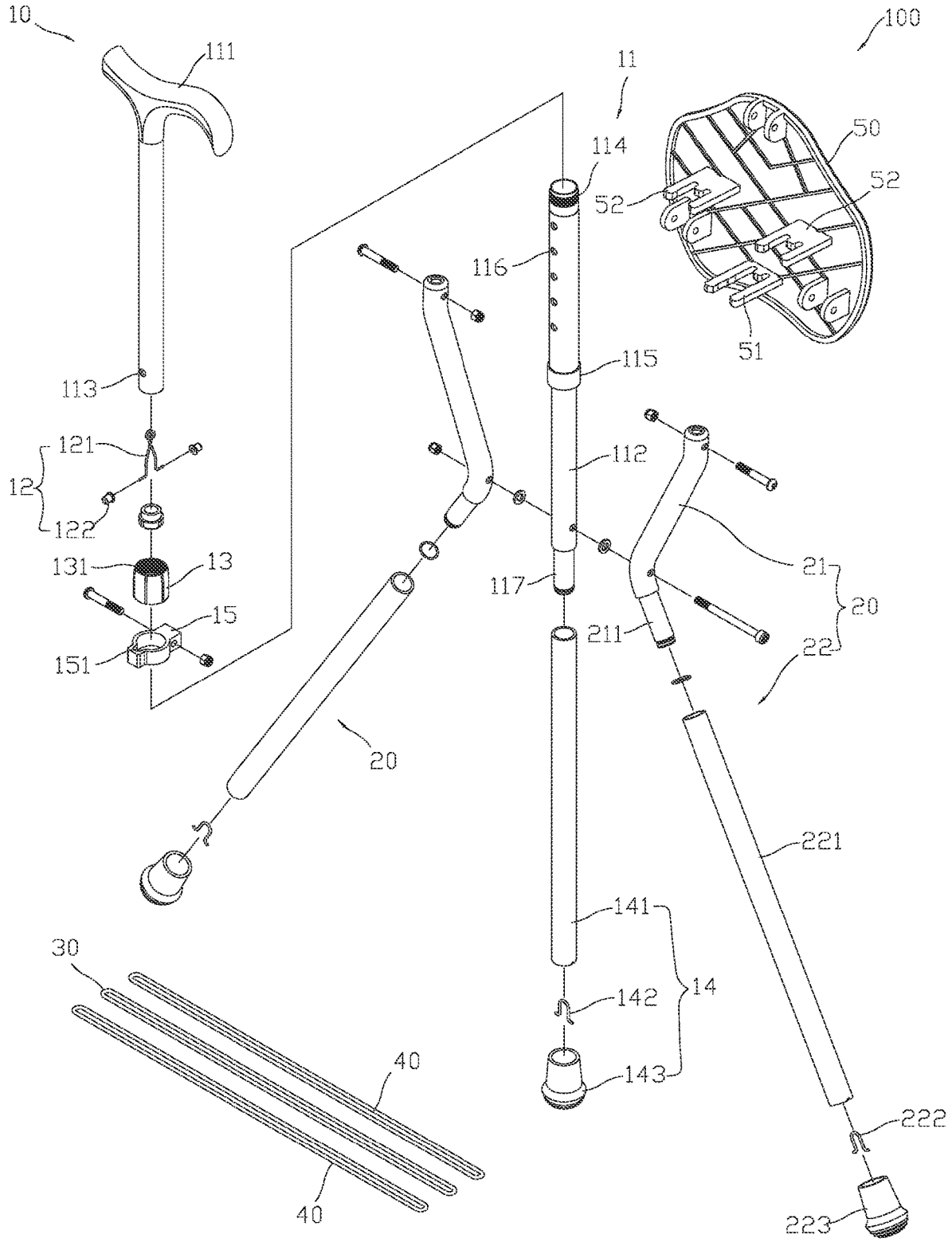
FIG. 1 is an exploded perspective view of a preferred embodiment of the present application.

| | |
|---|---|
| 100. Cane with seat | 10. Cane pole |
| 11. Pole body | 111. Pole head |
| 112. Pole shaft | 113. Through-hole |
| 114. Outer thread | 115. Limiting block |
| 116. Positioning hole | 117. Pole body insertion |
| 12. Adjusting member | 121. Elastic body |
| 122. Button | 13. Safety restraint ring |
| 131. Inner thread | 14. Pole foot |
| 141. Pole foot rod | 142. Pole foot fixing member |
| 143. Pole foot elastic base | 15. Sliding sleeve |
| 151. Escape groove | 20. Chair pole |
| 21. Pivot rod | 211. Chair foot insertion part |
| 22. Chair foot rod | 221. Chair foot rod body |
| 222. Chair foot fixing member | 223. Chair foot elastic base |
| 30. Cane pole elastic rope | 40. Chair pole elastic rope |
| 50. Chair cushion | 51. Pole foot clip |
| 52. Chair foot clip. | |

DETAILED DESCRIPTION

Please refer to FIG. 1 to FIG. 9, which show the specific structure of a cane with seat 100 according to a preferred embodiment of the present application, which mainly comprises a cane pole 10, two chair poles 20, a cane pole elastic rope 30, two chair pole elastic ropes 40 and a chair cushion 50, wherein:

as shown in FIG. 1 to FIG. 4, the cane pole 10 comprises a pole body 11, an adjusting member 12, a safety restraint ring 13, a pole foot 14 and a sliding sleeve 15. The pole body 11 comprises a pole head 111 and a pole shaft 112, the pole head 111 is T-shaped, and a top is configured to be hold by a human hand, a through-hole 113 is radially formed on one side near the bottom. The pole shaft 112 is a hollow tube body, and an outer thread 114 is formed on the outer peripheral surface of the top end. On the outer peripheral surface of the pole shaft 112, there is a surrounding convex limiting block 115 and a plurality of positioning holes 116 extending in the axial direction between the outer thread 114 and the limiting block 115. The bottom end of the pole shaft 112 comprises a pole body insertion part 117 with a reduced outer diameter. The top end of the pole shaft 112 is configured for insertion of a bottom end of the pole head 111. The adjusting member 12 comprises an elastic body 121 and a button 122, the elastic body 121 is fixedly connected to the inside of the pole head 111 of the pole body 11, the button 122 is connected with the elastic body 121, and goes outward through the through-hole 113 of the pole head 111 and any one of the positioning holes 116 of the pole shaft 112 under an action of an elastic force of the elastic body 121, so as to locate an axial relative position between the pole head 111 and the pole shaft 112. That is, by adjusting the positioning of the button 122 in the different positioning holes 116, the depth of the pole head 111 inserted into the pole shaft 112 is adjusted, thereby achieving the function of adjusting the height of the pole head 111; an inner peripheral surface of the safety restraint ring 13 is provided with an inner thread 131, and the inner thread 131 is screwed with the outer thread 114 of the pole shaft 112, when the safety restraint ring 13 is tightened by the external force, the pole shaft 112 is pressed against the pole head 111 to prevent the pole head 111 and the pole shaft 112 from moving relative to each other (that is, the pole head 111 and the pole shaft 112 cannot be displaced relative to each other at this time), when the safety restraint ring 13 is loosened by external force, the button 122 can be pressed to adjust the height of the pole head 111. The pole foot 14 comprises a pole foot rod 141, a pole foot fixing member 142 and a pole foot elastic base 143. The top end of the pole foot rod 141 and the pole body inserting portion 117 at the bottom end of the pole body 11 are inserted in a separable manner. The pole foot fixing member 142 is fixedly connected to the pole foot rod 141. The pole foot elastic base 143 is connected to the bottom end of the pole foot rod 141. The sliding sleeve 15 is sleeved on the outer peripheral surface of the pole shaft 112 of the pole body 11, and an escape groove 151 extended axially is formed concavely on an inner peripheral surface of the sliding sleeve 15, and the escape groove 151 faces a plurality of positioning holes 116.

Each of two chair poles 20 comprises a pivot rod 21 and a chair foot rod 22. The bottom end of the pivot rod 21 comprises a chair foot insertion part 211 with a reduced outer diameter. The chair foot rod 22 comprises a chair foot rod body 221, a chair foot fixing member 222 and a chair foot elastic base 223. The top end of the chair foot rod body 221 and the chair foot insertion part 211 at the bottom end of the pivot rod 21 are inserted in a separable manner. The chair foot fixing member 222 is fixedly connected in the chair foot rod body 221, and the chair foot elastic base 223 is connected to the bottom end of the chair foot rod body 221. The pivot rods 21 of the two chair poles 20 are pivotally connected to both sides of the rod shaft 112 of the pole body 11 of the cane pole 10.

The cane pole elastic rope 30 is located inside the cane pole 10, one end is fixedly connected with the pole shaft 112 of the pole body 11, and the other end is fixedly connected with the pole foot fixing member 142 of the pole foot 14.

The two chair pole elastic ropes 40 are respectively located inside the respective chair pole 20, one end of each chair pole elastic rope 40 is fixedly connected with the pivot rod 21 of the corresponding chair pole 20, and the other end is fixedly connected with the chair foot fixing member 222 of the chair foot rod 22 of the corresponding chair pole 20.

The front side of the chair cushion 50 can be used for the user's buttocks to sit on, and the back side comprises a cane foot clip 51 and two chair foot clips 52. The back side of the chair cushion 50 is pivotally connected with the sliding sleeve 15 of the cane pole 10 and the top ends of the pivot rods 21 of the two chair poles 20, so that the chair cushion 50 can pivot back and forth under the action of external force between a down-folded position and an up-lifted position.

Figure 5:
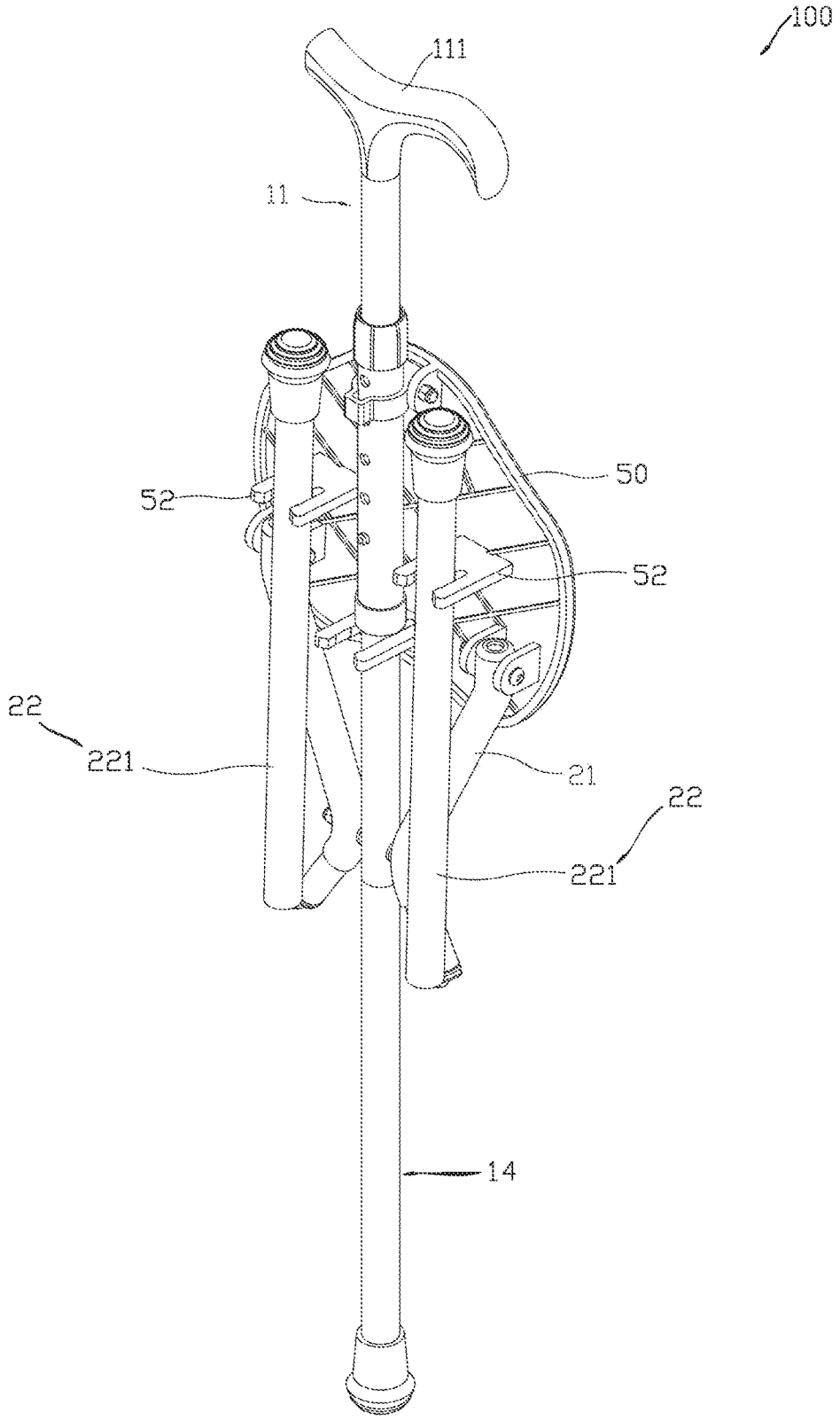
FIG. 5 is a perspective view of the preferred embodiment of the present application in the cane form.

The use method of this embodiment is described in detail as follows:

When you want to use this product as a walking stick, as shown in FIG. 5. First, fold the chair cushion 50 down to the down-folded position (the chair cushion is in an upright state at this time), and then apply a little force to separate the chair foot rod 22 of the chair pole 20 from the chair foot insertion part 211 the pivot rod 21, and then clamp the chair foot rod 22 into the chair foot clip 52 of the chair cushion 50. In this way, the product can be used as a walking stick.

Figure 2:
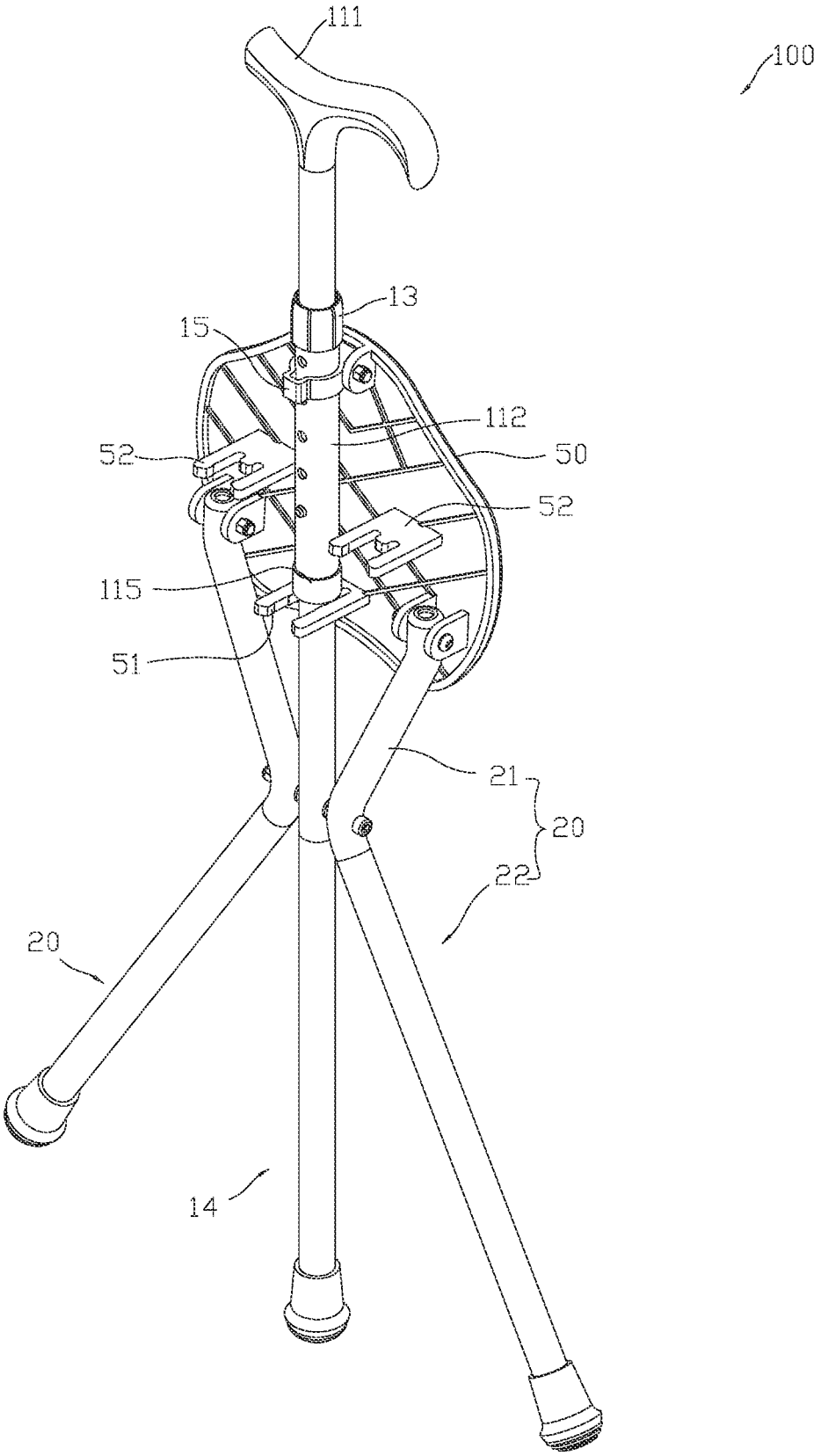
FIG. 2 is a perspective combined view of a preferred embodiment of the present application.
Figure 3:
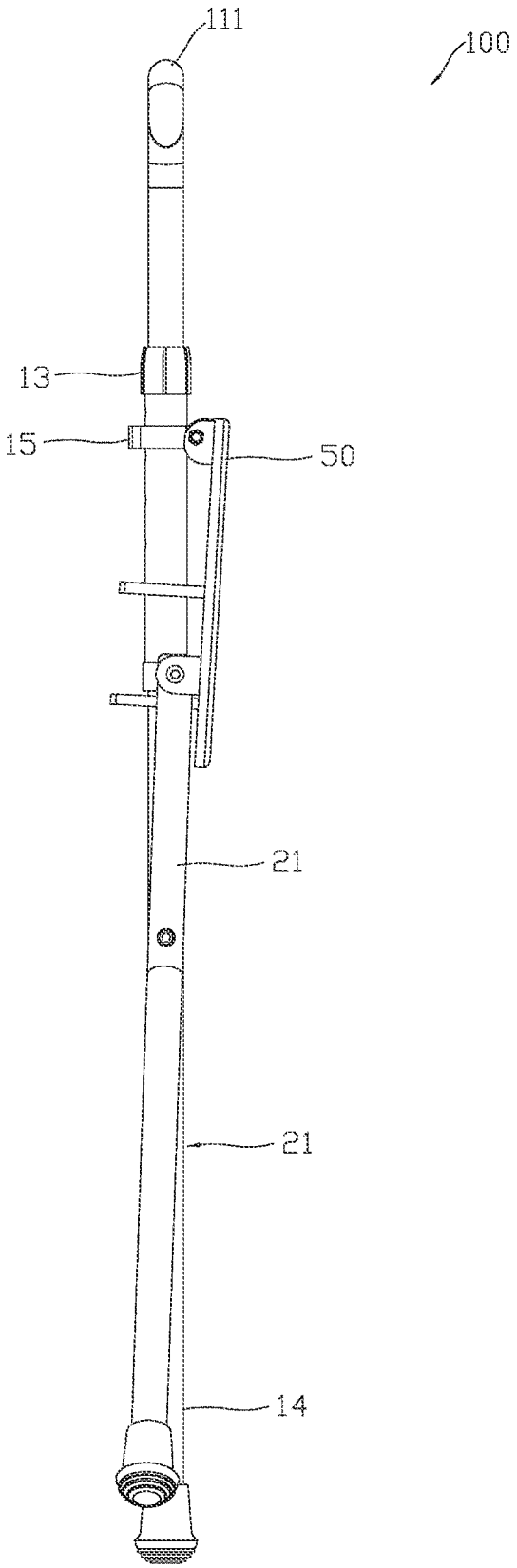
FIG. 3 is a side view of the preferred embodiment of the present application.
Figure 4:
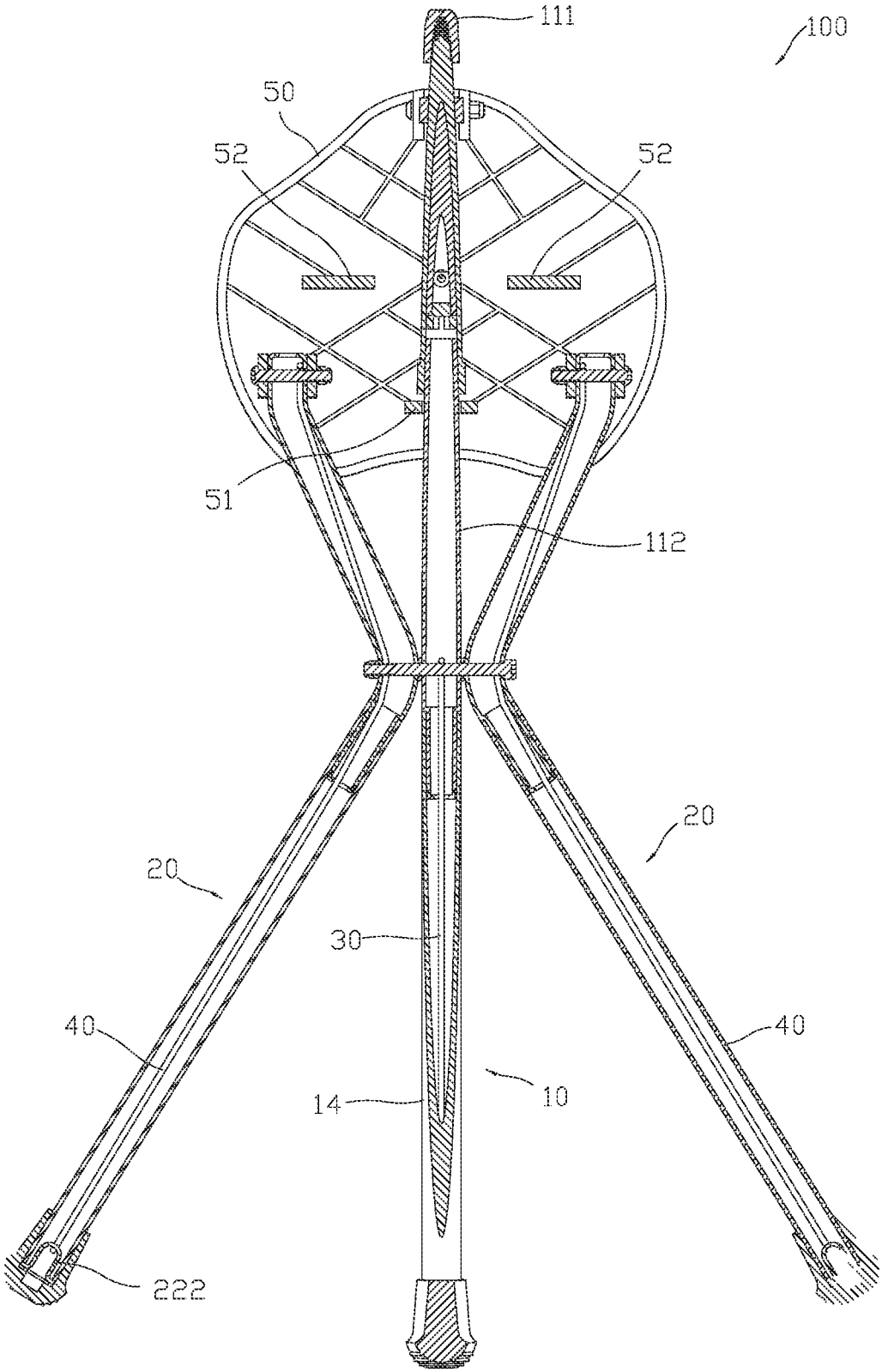
FIG. 4 is a cross-sectional view of a preferred embodiment of the present application.
Figure 6:
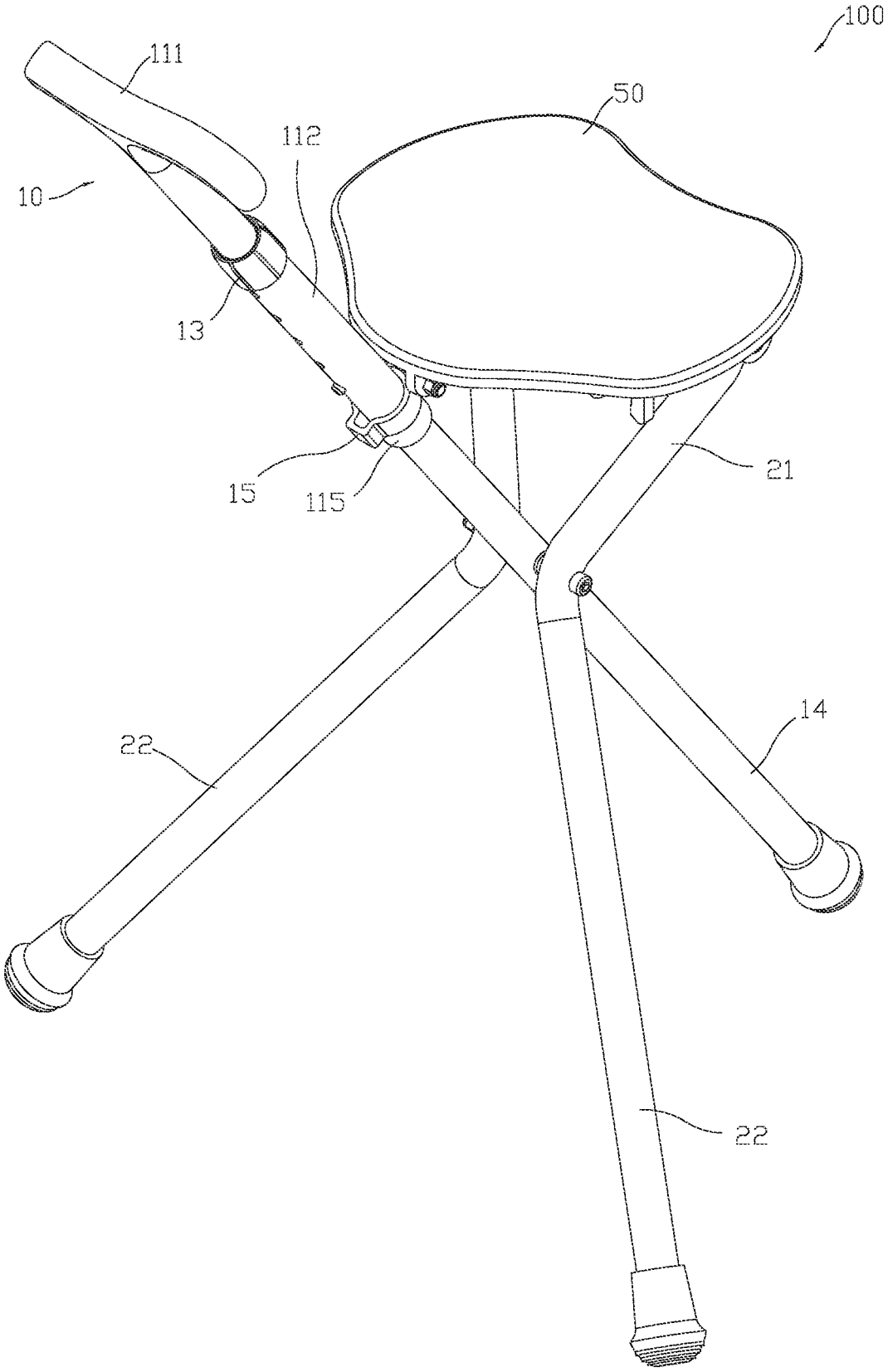
FIG. 6 is a perspective view of a preferred embodiment of the present application in the chair form.
Figure 7:
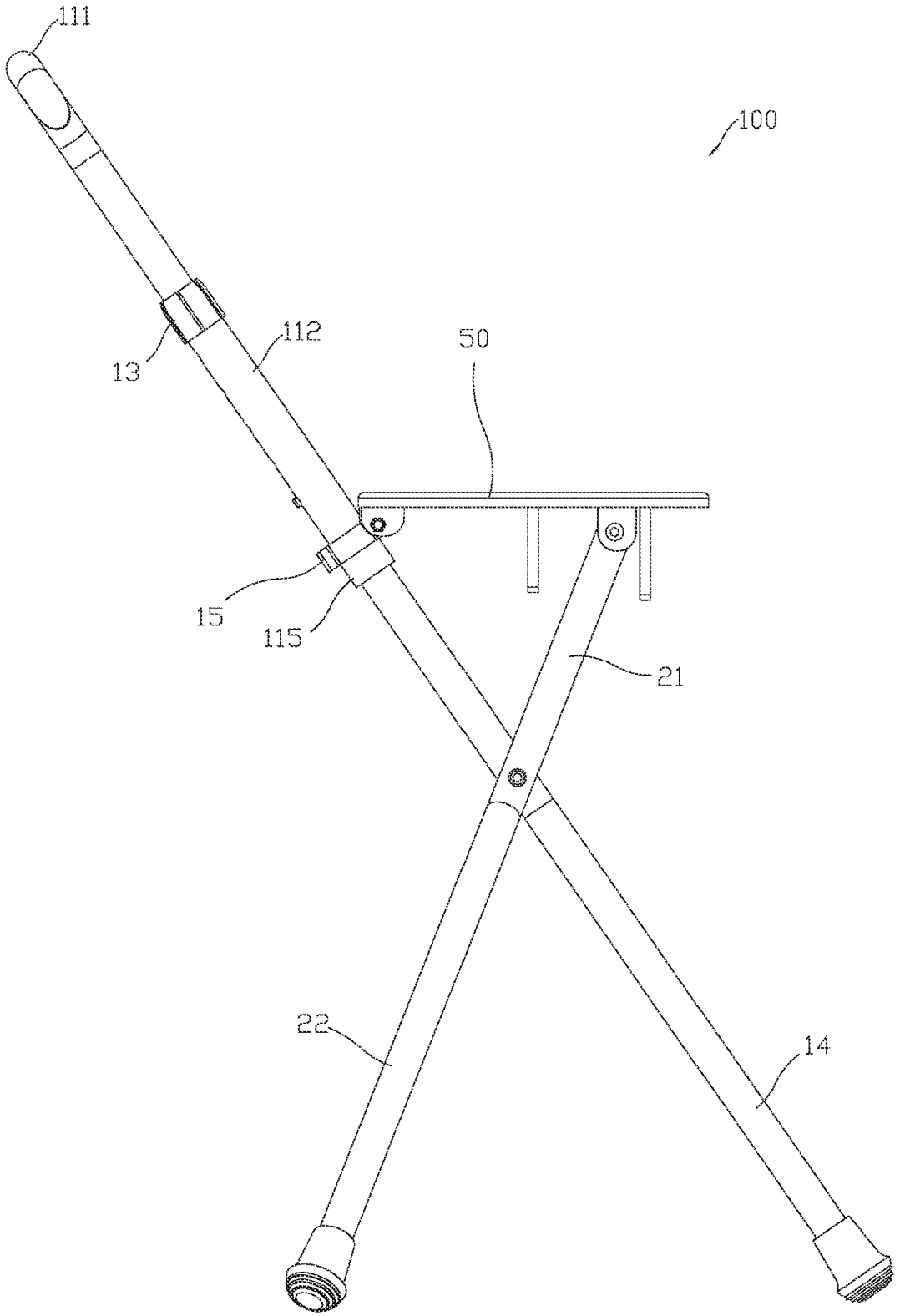
FIG. 7 is a side view of the preferred embodiment of the present application in the chair form.

When the user uses this product as a walking stick and needs to take a break after walking outside for a period of time. The chair foot rods 22 of the two chair poles 20 can be detached one by one from the chair foot clips 52 of the chair cushion 50. The chair foot rod 22 detached from the chair foot clip 52 will be acted by the restoring elastic force of the chair pole elastic rope 40, and will be pulled back in the direction of the pivot rod 21 by itself. As a result, the chair foot insertion part 211 of the pivot rod 21 can be automatically re-inserted into the top end of the chair foot rod 22 (as shown in FIG. 2). Next, as shown in FIG. 6 and FIG. 7, the chair cushion 50 is then pulled up from the down-folded position to the up-lifted position (the chair cushion is in a horizontal state at this time), and the two chair poles 20 are driven by the pivoting of the chair cushion 50, and forms an included angle with the cane pole 10, so that the bottom ends of the cane pole 10 and the two chair poles 20 can stand firmly on the ground. In this way, the product can be converted from a cane form to a chair form for the user to sit and rest. Of course, this product can not only be used by users to take a rest on the way out, but also can be used as a walking stick when users go out, and can be used directly as a chair after arriving at the destination, such as participating in various group activities (such as park performances, election speeches, etc.).

In addition, when the product is converted into a chair form (that is, when the chair cushion 50 is pivotally moved from the down-folded position to the up-lifted position), the sliding sleeve 15 will be driven by the chair cushion 50 and slide along the pole shaft 112 of the cane pole 10 until it is supported by the limit block 115 (as shown in FIG. 6 and FIG. 7). Not only can the limiting block 115 limit the unfolding angle of the chair poles 20, but also prevent the chair cushion 50 from sliding down by itself when the chair cushion 50 is used by the user, thereby achieving the effect of improving safety.

Secondly, when the sliding sleeve 15 is sliding, since the inner peripheral surface of the sliding sleeve 15 has the escape groove 151, the sliding sleeve 15 will not be in contact with the adjusting member 12 of the cane pole 10. This makes the product operate more smoothly.

Figure 8:
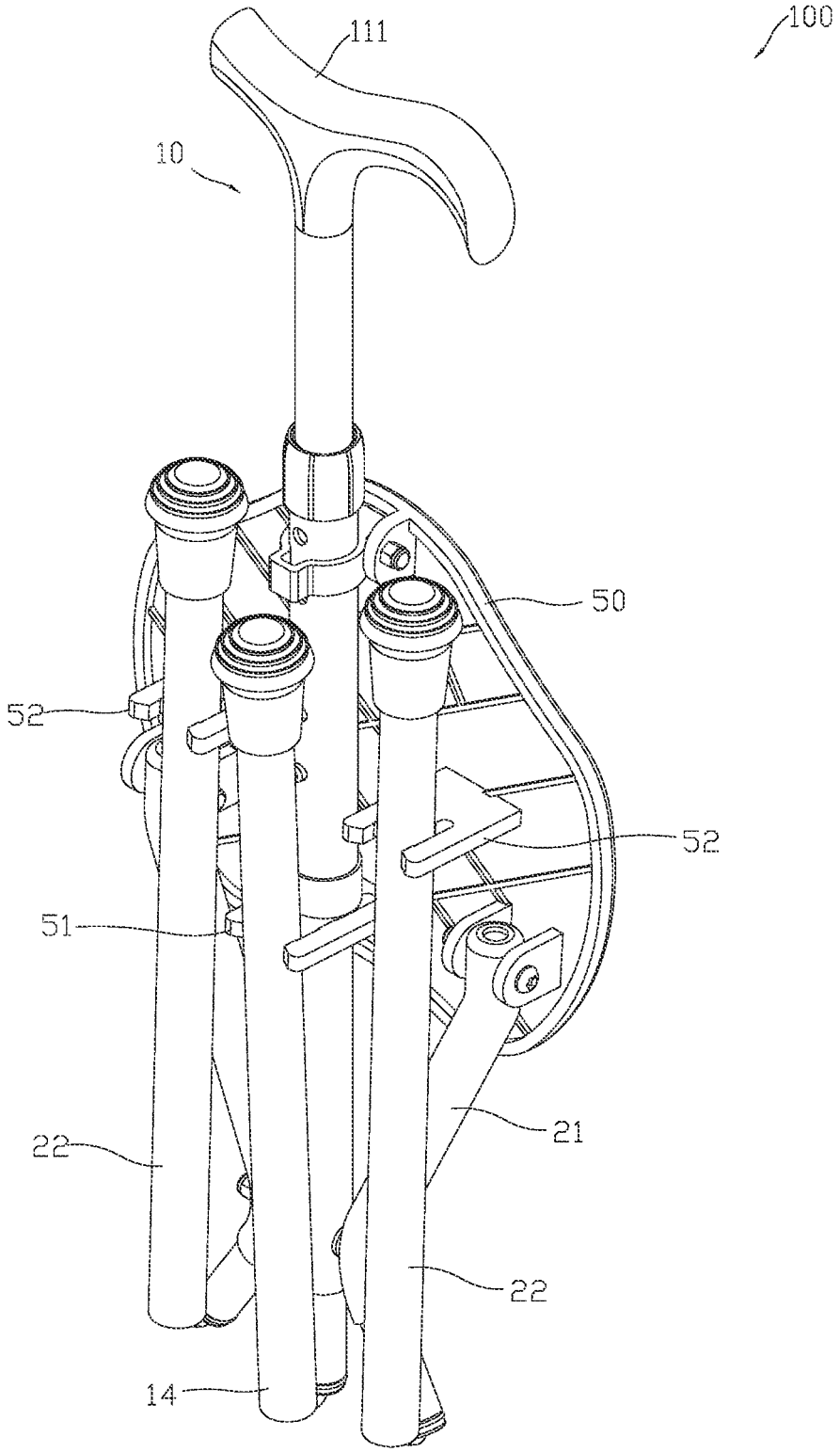
FIG. 8 is a perspective view of a preferred embodiment of the present application in the storage form.
Figure 9:
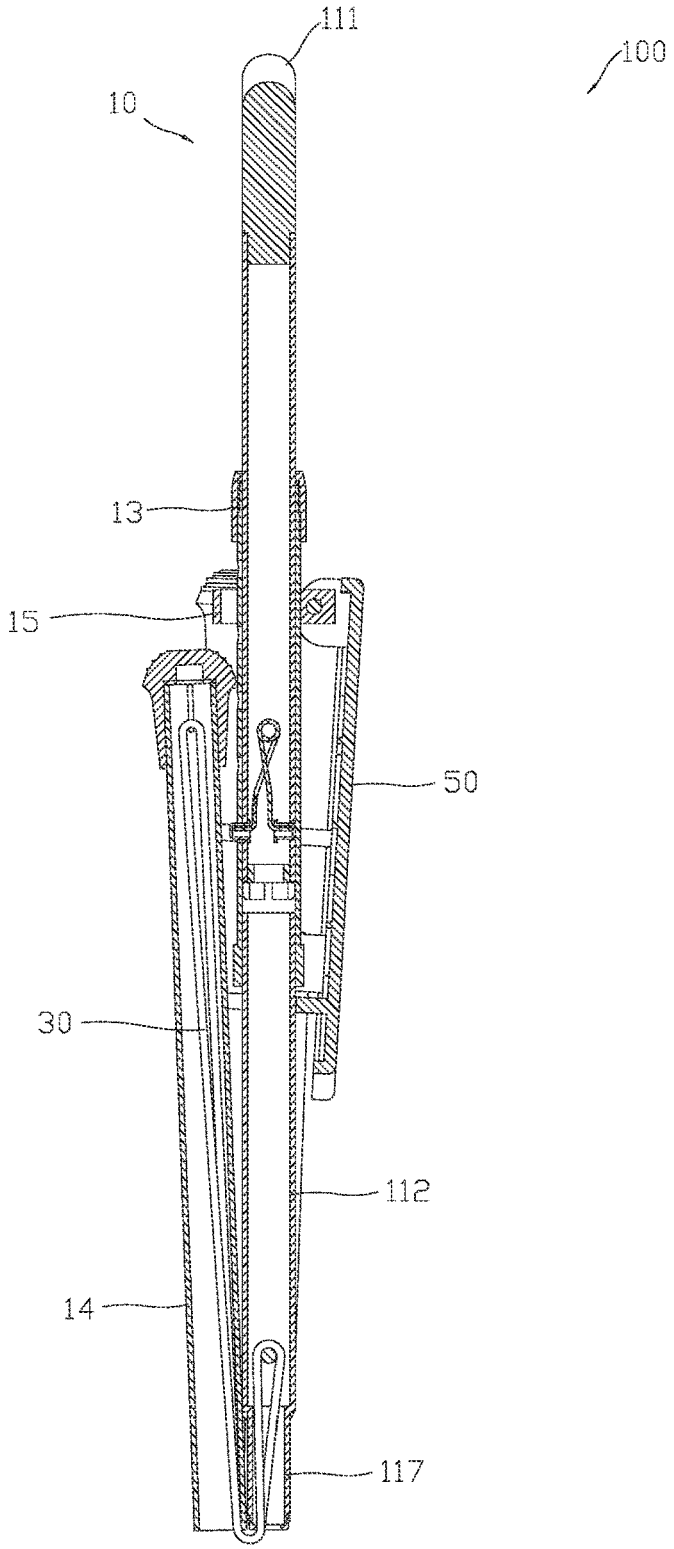
FIG. 9 is a cross-sectional view of a preferred embodiment of the present application in the storage form.

Next, when you want to store the product without using the product, lift the chair cushion 50 up to the up-lifted position first, then separate the pole foot 14 of the cane pole 10 from the pole shaft 112 of the pole body 11, and clamp the separated pole foot 14 into the pole foot clips 51 of the chair cushion 50 (as shown in FIG. 8 and FIG. 9), and then separate the chair foot rod 22 of the chair pole 20 from the pivot rod 21, and clamp the chair foot rod 22 into the chair foot clip 52 of the chair cushion 50. In this way, after the product is converted into a storage form, a large amount of volume can be reduced to facilitate storage without occupying space.

Of course, if you want to convert the product into a cane form, then pull out the pole foot 14 of the cane pole 10 from the pole foot clips 51, so that the pole foot 14 is automatically pulled back toward the rod body 11 under the action of the elastic force of the cane pole elastic rope 30, so that the pole body insertion part 117 is automatically inserted into the top end of the pole foot 14 again.

This product can be easily converted into cane form, chair form and storage form for convenience in use. In this product, the pole head 111 of the pole body 11 of the cane pole 10 can be positioned by the adjusting member 12 in different positioning holes 116, and then pulled up or pushed down, so as to achieve the effect of adjusting the overall height of the cane pole 10. This enables users with different heights and hand lengths to use this product in accordance with their own height and body shape, so as to achieve the comfort of use. That is, this product can be applied to most users and is highly competitive in the market.

The above are only the preferred embodiments of the present application, and are not intended to limit the present application. Therefore, any modification, equivalent replacement, improvement, etc. made to the above embodiments according to the technical practice of the present application still fall within the scope of the technical solution of the present application.

What is claimed is:

1. A cane with seat, comprising:

a cane pole, comprising a pole body, a pole foot and a sliding sleeve, a peripheral surface of the pole body is provided with a protruding limiting block, a top end of the pole foot is combined with a bottom end of the pole body, and the sliding sleeve is slidably sleeved on the outer peripheral surface of the pole body;

two chair poles, each with a pivot rod and a chair foot rod, the top of each chair foot rod is detachably inserted into a bottom end of the corresponding pivot rod, the pivot rods of the two chair poles are pivotally connected to both sides of the pole body of the cane;

two chair pole elastic ropes, respectively arranged inside the corresponding chair poles, one end of each chair pole elastic rope is connected to the corresponding pivot rod, and the other end is connected to the corresponding chair foot rod, so as to provide an elastic force to make the chair foot rod move to the pivot rod;

a chair cushion, a back surface of which is provided with two chair foot clips, the back surface of the chair cushion is pivotally connected with the sliding sleeve of the cane and the pivoting rods of the two chair poles;

the back of the chair cushion further comprises a pole foot clip, wherein the cane with seat is configured to be able to convert into a storage form, when the cane is in the storage form, the chair cushion is in an up-lifted position, and the pole foot is separated from the pole body, and the pole foot is clamped in the pole foot clip, each chair foot rod is separated from its corresponding pivot rod, and each chair foot rod is clamped into its corresponding chair foot clip.

2. The cane with seat according to claim 1, further comprising a cane pole elastic rope; the top end of the pole foot and the bottom end of the pole body are detachably inserted together, the cane pole elastic rope is arranged inside the cane pole, and one end of the cane pole elastic rope is connected inside the pole body, and the other end is connected inside the pole foot, so as to provide an elastic force to make the pole foot move to the pole body.

3. The cane with seat according to claim 2, wherein the pole foot comprises a pole foot rod, a pole foot fixing member and a pole foot elastic base, and a bottom end of the pole body is inserted into a top end of the pole foot rod, the pole foot fixing member is fixedly connected in the pole foot rod, the pole foot fixing member is connected with the cane pole elastic rope, and the pole foot elastic base is connected with a bottom end of the pole foot rod.

4. The cane with seat according to claim 2, wherein the bottom end of the pole body comprises a pole body insertion part with a reduced outer diameter, and the pole body insertion part is inserted into the top end of the pole foot; the bottom end of the pivot rod of each chair pole comprises a chair foot insertion part with a reduced outer diameter, and the chair foot insertion part is inserted into the top end of the corresponding chair foot rod.

5. The cane with seat according to claim 1, wherein the cane pole comprises an adjusting member and a safety restraint ring; the pole body comprises a pole head and a pole shaft, the pole head is T-shaped, and a top is configured to be hold by a human hand, a through-hole is formed on one side of the pole head, an outer thread is provided on an outer peripheral surface of a top end of the pole shaft, the protruding limiting block is arranged on the pole shaft, and the pole shaft comprises a plurality of positioning holes, which extend along an axial direction between the outer thread and the limiting block, the top end of the pole shaft is configured for insertion of a bottom end of the pole head, the pivot rods of the two chair poles are pivotally connected to both sides of the pole shaft; the adjusting member comprises an elastic body and a button, the elastic body is fixedly connected to the inside of the pole head, the button is connected with the elastic body, and goes outward through the through-hole of the pole head and any one of the positioning holes of the pole shaft under an action of an elastic force of the elastic body, so as to locate an axial relative position between the pole head and the pole shaft, when the button is located in different positioning holes, the depth of the pole head inserted into the pole shaft can be adjusted to change the overall height of the cane pole; an inner peripheral surface of the safety restraint ring is provided with an inner thread, and the inner thread is screwed with the outer thread of the pole shaft, when the safety restraint ring is tightened by the external force, the pole shaft is pressed against the pole head, so that the pole head and the pole shaft cannot be displaced relative to each other, when the safety restraint ring is loosened by external force, the button can be pressed to cause the relative displacement of the pole head and the pole shaft; the sliding sleeve is sleeved on the pole shaft, and an escape groove extending axially is formed concavely on an inner peripheral surface of the sliding sleeve, and the escape groove faces the plurality of positioning holes.

6. The cane with seat according to claim 1, wherein each chair foot rod of the chair poles comprises a chair foot rod body, a chair foot fixing member and a chair foot elastic base, and the chair foot fixing member is fixedly connected to inside of the chair foot rod body, the chair foot fixing member is connected with the corresponding chair pole elastic rope, and the chair foot elastic base is connected with a bottom end of the chair foot rod body.

7. The cane with seat according to claim 1, wherein the cane with seat is configured to be converted between a cane form and a chair form by the user.

8. The cane with seat according to claim 7, wherein when in the cane form, the chair cushion is in a down-folded position, the chair foot rod of each chair pole is separated from its corresponding pivot rod, and each chair foot rod is clamped into its corresponding chair foot clip of the chair cushion.

9. The cane with seat according to claim 7, wherein when in the chair form, each pivot rod is inserted into its corresponding chair foot rod, the chair cushion is in the up-lifted position, and the two chair poles are driven by the chair cushion and form an included angle with the cane pole, the sliding sleeve is driven by the chair cushion, and slides along the pole body to abut against the limiting block.

10. The cane with seat according to claim 1, wherein the limiting block is circumferentially arranged on the outer peripheral surface of the pole body.

* * * * *